US006598700B1

(12) United States Patent
Schroeder

(10) Patent No.: US 6,598,700 B1
(45) Date of Patent: Jul. 29, 2003

(54) COMPRESSION MOLDED CELLULOSE (CMC) LOUDSPEAKER CABINETS AND METHOD FOR MAKING SAME

(76) Inventor: Ernest C. Schroeder, 401 Goldsbourgh St., Easton, MD (US) 21601

( * ) Notice: Subject to any disclaimer, the term of this patent is extended or adjusted under 35 U.S.C. 154(b) by 0 days.

(21) Appl. No.: 09/517,296

(22) Filed: Mar. 2, 2000

Related U.S. Application Data

(60) Provisional application No. 60/129,377, filed on Apr. 15, 1999.

(51) Int. Cl.[7] ..... A47B 81/06
(52) U.S. Cl. ..... 181/199; 181/153; 181/151
(58) Field of Search ..... 181/151, 153, 181/146, 199, 148, 150, 156

(56) References Cited

U.S. PATENT DOCUMENTS

| | | | | |
|---|---|---|---|---|
| D81,184 | S | 5/1930 | French | |
| 3,435,910 | A | 4/1969 | Lahti | |
| 3,679,022 | A | 7/1972 | Ohashi | |
| 3,757,890 | A * | 9/1973 | Dunning | 181/199 |
| 4,082,159 | A | 4/1978 | Petty | |
| 4,109,983 | A | 8/1978 | Kinoshita | |
| 4,219,099 | A | 8/1980 | Sacks | |
| 4,341,838 | A | 7/1982 | Imai et al. | |
| 4,404,315 | A | 9/1983 | Tsukagoshi et al. | |
| 4,440,259 | A * | 4/1984 | Stohbeen | 181/153 |
| 4,451,609 | A | 5/1984 | Kawahara et al. | |
| 4,518,642 | A | 5/1985 | Johnston et al. | |
| 4,539,252 | A | 9/1985 | Franz | |
| 4,596,305 | A | 6/1986 | Jagborn | |
| 4,611,686 | A | 9/1986 | Kobayashi et al. | |
| 4,640,381 | A | 2/1987 | Tsuchiya et al. | |
| 4,650,031 | A | 3/1987 | Yamamoto | |
| 4,754,852 | A | 7/1988 | Mule et al. | |
| 4,805,729 | A | 2/1989 | Wascom | |
| 4,811,403 | A | 3/1989 | Henricksen et al. | |
| 4,865,153 | A | 9/1989 | Toyoda | |
| 4,964,482 | A | 10/1990 | Meyer | |
| D317,008 | S | 5/1991 | Emmerling | |
| D319,243 | S | 8/1991 | Yamakawa | |
| D319,446 | S | 8/1991 | Yamamoto | |
| 5,115,884 | A | 5/1992 | Falco | |
| 5,194,701 | A | 3/1993 | Yamada-Scriba | |
| D334,935 | S | 4/1993 | Goto | |
| 5,206,466 | A | 4/1993 | Inamiya | |
| 5,218,176 | A | 6/1993 | Meyer, Jr. | |
| D338,672 | S | 8/1993 | Watanabe et al. | |
| 5,274,199 | A | 12/1993 | Uryu et al. | |
| 5,284,222 | A | 2/1994 | Ito | |
| D344,951 | S | 3/1994 | Christie | |
| 5,406,637 | A | 4/1995 | Gonzalez | |
| 5,417,909 | A | 5/1995 | Michels et al. | |
| D359,050 | S | 6/1995 | Deguchi | |
| 5,473,121 | A | 12/1995 | Uryu | |
| D368,717 | S | 4/1996 | Lenart et al. | |
| 5,519,178 | A | 5/1996 | Ritto et al. | |
| D377,176 | S | 1/1997 | Ito et al. | |
| D384,353 | S | 9/1997 | Nudell et al. | |
| 5,691,516 | A | 11/1997 | Thomasen | |
| D390,845 | S | 2/1998 | Hakoda | |
| D399,510 | S | 10/1998 | Renk | |
| D404,036 | S | 1/1999 | Shin et al. | |
| 5,916,405 | A | 6/1999 | Ritto et al. | |
| 5,949,033 | A | 9/1999 | Anagnos | |

* cited by examiner

*Primary Examiner*—Khanh Dang
(74) *Attorney, Agent, or Firm*—John N. Coulby; Collier Shannon Scott, PLLC

(57) ABSTRACT

The present invention relates to loudspeaker cabinets composed of a moldable wood material and a method for making the same. In particular, the present invention relates to loudspeaker cabinets composed of a compression molded cellulose (CMC) material resulting in a cabinet for loudspeakers with improved acoustic and physical properties. In accordance with the present invention, a compression molded cellulose material, and a process for the mixing, extrusion, and compression molding of the compression molded cellulose material has been developed. Cabinet designs with rounded forms are made possible using the compression molded cellulose material and process. The characteristics of the compression molded cellulose material in combination with the unique shape of each cabinet is designed to enhance the fidelity of the sound produced by the loudspeaker mounted in the cabinet.

44 Claims, 6 Drawing Sheets

COMPRESSION MOLDED CELLULOSE (CMC) LOUDSPEAKER CABINETS AND METHOD FOR MAKING SAME

CROSS REFERENCE TO RELATED PATENT APPLICATION

This application relates to and claims priority on provisional application Ser. No. 60/129,377, filed Apr. 15, 1999 and entitled "Compression Molded Cellulose (CMC) Loudspeaker Cabinets and Method for Making Same."

FIELD OF THE INVENTION

The present invention relates to loudspeaker cabinets composed of a moldable wood material and a method for making the same. In particular, the present invention relates to loudspeaker cabinets composed of a compression molded cellulose (CMC) material resulting in a cabinet for loudspeakers with improved acoustic and physical properties.

BACKGROUND OF THE INVENTION

The quality of sound created by a loudspeaker is significantly influenced by the shape of the cabinet in which it is mounted and by the acoustic properties of the material from which the cabinet is made.

Loudspeaker cabinets are traditionally constructed of various types of wood or fabricated wood materials such as particle-board, press board, plywood, and fiberboard that are available only in sheet form. Cabinets fabricated from sheets of material possess angular junctions and flat internal surfaces that degrade the accuracy of the sound generated by the loudspeaker. Flat internal cabinet surfaces reflect sound waves in a regular pattern that interfere with the waves emanating from the loudspeaker. This interference creates standing wave cancellation resulting in distortion and loss of loudspeaker efficiency. The quality of reproduced sound from traditional "box" shaped loudspeaker cabinets is inferior to the quality of reproduced sound from loudspeaker cabinets incorporating curved internal surfaces. Curved internal cabinet surfaces reflect sound waves randomly thereby minimizing standing wave cancellation and distortion and enhancing efficiency.

Additionally, the leakage of air at the connection points of flat panels adversely affects the loudspeaker's overall performance. Molded cabinet construction eliminates joints thereby ensuring a leak-proof cabinet.

Traditional cabinet materials are available only in fixed densities as they are generally intended for architectural and/or structural applications. The densities are not always ideal for acoustic applications since the rate of decay of the sound energy in the material directly affects the quality of the sound produced by the loudspeaker incorporated into cabinets composed of these materials. In contrast, the density of compression molded cellulose (CMC), the present invention, can be controlled and modified by formulation and process variations to conform to specific acoustic criteria. This flexibility greatly enhances the quality of the sound from the loudspeaker mounted in the CMC cabinet.

There is a need in the industry for loudspeaker cabinets, and a material and process for making the same, with improved acoustic and physical properties. There is also a need in the industry, especially the automotive, marine, and other applications, for a loudspeaker cabinet and material with a greater resistance to water, weather, and abrasion damage. There is also a need in the industry for a moldable material with improved physical properties such as abrasion and water resistance for use in non-loudspeaker applications.

Currently available loudspeaker cabinets are also limited in the designs available with regard to shape and surface detail due to the materials employed. Plastic or non-cellulose based materials may be available, but are not readily capable of accepting paint or other decorative treatments, may be difficult to work with, and the costs of production may be prohibitively high.

In many applications, loudspeaker performance is enchanced if the cabinet can be made airtight. Cabinet construction using traditional materials with angular joints makes airtight cabinet construction nearly impossible. There is a need in the industry to provide cabinets that are airtight.

There is also a need in the industry to provide loudspeaker cabinets with various densities to match the requirements of the loudspeaker. There is also a need in the industry to be able to manufacture cabinets with the above advantages from readily available materials with predictable costs. There is also a need in the industry to provide loudspeaker cabinets with an increased service life which are not susceptible to rot or other types of decay or degradation. There is also a need in the industry for a material which is capable of being manipulated (cut, drilled, threaded, sanded, etc.) easily with standard tools and techniques. There is also a need in the industry to provide loudspeaker cabinets which are not only impermeable to water and other liquids, but also to gases and other fumes which may be harmful to the loudspeaker components. There is also a need in the industry to provide loudspeaker cabinets not only with varying material densities, but also with controllable and variable wall thickness.

OBJECTS OF THE INVENTION

It is an object of the present invention to provide a material and process with which to fabricate loudspeaker cabinets having improved acoustic properties.

It is another object of the present invention to provide a material and process with which to fabricate loudspeaker cabinets having improved physical properties.

It is a further object of the present invention to provide a material and process with which to fabricate loudspeaker cabinets having unlimited design latitude with regard to shape and surface detail.

It is still another object of the present invention to provide a material and process with which to fabricate loudspeaker cabinets having high resistance to water and weather and abrasion damage.

It is yet another object of the present invention to provide a material and process with which to fabricate loudspeaker cabinets capable of accepting paint and or other decorative treatments.

It is still yet another object of the present invention to provide a material and process with which to fabricate loudspeaker cabinets having a lower per unit fabricated cost.

It is another object of the present invention to provide a material and process with which to fabricate loudspeaker cabinets having the ability to be produced by simple methods such as low-pressure compression molding using fabricated tooling.

It is another object of the present invention to provide a material and process with which to fabricate loudspeaker cabinets having few or no seams or joints ensuring an air-tight enclosure.

It is another object of the present invention to provide a material and process with which to fabricate loudspeaker cabinets of varying material densities to meet the specific requirements of various acoustic applications.

It is another object of the present invention to provide a material and process with which to fabricate loudspeaker cabinets from readily attainable materials with predictable costs.

It is another object of the present invention to provide a material and process with which to fabricate loudspeaker cabinets with long service life capability.

It is another object of the present invention to provide a material and process with which to fabricate loudspeaker cabinets with the capability of being manipulated with standard tools and techniques.

It is another object of the present invention to provide a material and process with which to fabricate loudspeaker cabinets that are impermeable to water and air.

It is another object of the present invention to provide a material and process with which to fabricate loudspeaker cabinets that are of controllable and uniform wall thickness.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, economical material and process yielding weatherproof cabinets of any shape, which have greater acoustic integrity and improved physical properties at a lower cost per unit. The material, compression molded cellulose (CMC) is a novel blend of wood fibers and other organic and inorganic fillers bonded within a matrix of thermoset resins.

In accordance with the present invention, a process for the mixing, extrusion, and compression molding of the CMC material has been developed which employs standard commercially available equipment in combination with specifically designed presses and molds. The equipment employed is inexpensive and simple to maintain and operate.

Molds developed for this process and material may be fabricated quickly at low cost and at the site of production of the loudspeaker cabinets. Cabinet designs with rounded forms are made possible using the material and process. The characteristics of the material in combination with the unique shape of each cabinet is designed to enhance the fidelity of the sound produced by the loudspeaker by reducing the sound-wave cancellation and distortion typically found in cabinets with flat surfaces. (See FIG. 6 and FIG. 7 for results of free air testing of an embodiment of the present invention, a typical 10", 0.65 cu. ft. sub woofer cabinet).

In an embodiment of the present invention, a loudspeaker cabinet comprises at least one wall made of a compression molded cellulose material. The loudspeaker cabinet may comprise a face portion, a shell portion, and means to join the face portion to the shell portion, wherein the shell portion and/or the face portion is composed of a compression molded cellulose material. The loudspeaker cabinet may include a shell portion containing a recessed area to accommodate speaker terminal connections, and a face portion possessing a means to mount a loudspeaker to the face portion. The loudspeaker cabinet may possess a shell portion and a face portion with curved interior and exterior surfaces. The loudspeaker cabinet may also contain compression molded cellulose material that is of uniform density.

In an embodiment of the present invention the loudspeaker cabinet of compression molded cellulose material may comprise thermoset resins in the range of 25–85% and a catalyst in the range of 1–5%. In addition to the thermoset resins and the catalyst, the loudspeaker cabinet of compression molded cellulose material may be comprised of at least one of the following: milled glass fiber in the range of 1–10%; fine wood flour in the range of 1–20%; course wood flour in the range of 10–40%; glass beads in the range of 5–20%; fly ash in the range of 5–20%; colloidal silica in the range of 0.5–3%; fine grind calcium carbonate in the range of 5–20%; alumina trihydrate in the range of 5–20%; elastomeric particulate in the range of 2–15%; a foaming agent in the range of 1–3%; organic fibers in the range of 5–10%; and finely divided metallic material in the range of 20–50%.

The thermoset resins may be selected from, but not limited to, the group comprising polyester thermoset resins, unsaturated polyester thermoset resins, polyurethane thermoset resins, epoxy thermoset resins, and phenolic thermoset resins. The thermoset resin may be a blended unsaturated polyester thermoset resin, or any hybrid combination of thermoset resins. The fine wood flour may be mesh size 100–200, the course wood flour may be mesh size 10–50, the elastomeric particulate may be comprised of rubber and/or rubber tire regrind.

The catalyst may be, but is not limited to, Methyl Ethyl Ketone Peroxide and/or Methyl Ethyl Ketone Peroxide 9% free oxygen. The foaming agent may be 1,1-dimethylethyl hydrazine chloride and/or iron chloride. The organic fibers may be mesh size 10–60 and may be jute. The metallic material may be, but is not limited to, lead.and/or aluminum.

In an embodiment of the present invention, a loudspeaker cabinet may be comprised of a compression molded cellulose material, wherein the compression molded cellulose material comprises unsaturated polyester thermoset resins in the range of 90–99% and the catalyst Methyl Ethyl Ketone Peroxide 9% free oxygen in the range of 1–10%.

A method of manufacturing a loudspeaker cabinet of a compression molded cellulose material may comprise the steps of: blending dry compression molded cellulose ingredients in a first blender to form a blended dry compression molded cellulose mixture; mixing liquid compression molded cellulose ingredients, excluding a catalyst, in a first mixer to form a mixed liquid compression molded cellulose mixture; continuously combining the blended dry compression molded cellulose mixture and the mixed liquid compression molded cellulose mixture in a second mixer to form a high viscosity compression molded cellulose mixture; pumping the high viscosity compression molded cellulose mixture into a third mixer by means of a first pump while simultaneously introducing a catalyst into the high viscosity compression molded cellulose mixture by means of a second pump to form a catalyzed compression molded cellulose mixture; extruding the catalyzed compression molded cellulose mixture into at least one male or female mold of at least one of a male and female mold set; heating the catalyzed compression molded cellulose mixture upon introduction to the at least one male or female mold to 100–200 degrees F.; closing the at least one mold set to distribute the catalyzed compression molded cellulose mixture; compressing the at least one mold set to pressures of between 5–100 PSI; maintaining the pressure until the catalyzed compression molded cellulose mixture forms at least one cured compression molded cellulose part; opening the at least one mold set and removing the at least one cured compression molded cellulose part; removing flash from the at least one cured compression molded cellulose part; and bonding the at least one cured compression molded cellulose part using a compatible adhesive.

The dry compression molded cellulose ingredients may comprise at least one of milled glass fiber, fine wood flour, course wood flour, glass beads, fly ash, colloidal silica, calcium carbonate, alumina trihydrate, elastomeric particulate, organic fibers, or finely divided metallic material. The liquid compression molded cellulose ingredients may comprise thermoset resins and/or a foaming agent. The first blender may be a ribbon blender. The first mixer may be a high shear mixer of the batch or continuous type. The second mixer may be an auger mixer.

The high viscosity compression molded cellulose mixture may be formed in a temperature and/or vacuum controlled environment. The high viscosity compression molded cellulose mixture may be pumped into the third mixer at a rate of 7000–10000 centimeters per second. The third mixer may be a static mixer or a multi element static mixer. The first pump and the second pump may be positive displacement pumps, and the first pump may be functionally linked to the second pump.

The catalyzed compression molded cellulose mixture may be extruded into the at least one male or female mold by use of a metering extrusion head. The catalyzed compression molded cellulose mixture may heated by means of at least one heated mold surface and/or by means of at least one heater at the point of extrusion. The pressure may be maintained from between 5–20 minutes after addition of the catalyst.

In an embodiment of the present invention, a loudspeaker cabinet may be comprised of compression molded cellulose material, wherein the compression molded cellulose material comprises: thermoset resin in the range of 71–83%; coarse wood in the range of 10–16%; fine wood in the range of 1–3%; glass bead in the range of 4–8%; silica in the range of 0.1–2%; and catalyst in the range of 1–3%. The thermoset resin may be an unsaturated polyester thermoset resin. The course wood may 20 mesh pine wood flour. The fine wood may 100 mesh pine wood. The silica may be AeroSil. The catalyst may be Methyl Ethyl Ketone Peroxide 9% free oxygen.

In an embodiment of the present invention, the compression molded cellulose material may comprise thermoset resins in the range of 25–85% and a catalyst in the range of 1–5%. In addition, the compression molded cellulose material may comprise at least one of the following: milled glass fiber in the range of 1–10%; fine wood flour in the range of 1–20%; course wood flour in the range of 10–40%; glass beads in the range of 5–20%; fly ash in the range of 5–20%; colloidal silica in the range of 0.5–3%; fine grind calcium carbonate in the range of 5–20%; alumina trihydrate in the range of 5–20%; elastomeric particulate in the range of 2–15%; a foaming agent in the range of 1–3%; organic fibers in the range of 5–10%; and finely divided metallic material in the range of 20–50%.

The thermoset resins may be selected from, but not limited to, the group comprising polyester thermoset resins, unsaturated polyester thermoset resins, polyurethane thermoset resins, epoxy thermoset resins, and phenolic thermoset resins. The thermoset resin may be a blended unsaturated polyester thermoset resin, or any hybrid combination of thermoset resins. The fine wood flour may be mesh size 100–200, the course wood flour may be mesh size 10–50, the elastomeric particulate may be comprised of rubber and/or rubber tire regrind.

The catalyst may be, but is not limited to, Methyl Ethyl Ketone Peroxide and/or Methyl Ethyl Ketone Peroxide 9% free oxygen. The foaming agent may be 1,1-dimethylethyl hydrazine chloride and/or iron chloride. The organic fibers may be mesh size 10–60 and may be jute. The metallic material may be, but is not limited to, lead.and/or aluminum.

All the above elements work together to yield a loudspeaker cabinet with excellent sound quality at a practical cost. The novel characteristics of the CMC material permit fabrication of the cabinets in various shapes, sizes and densities in order to match the requirements of the loudspeaker. The process and tooling permit the cabinet to be fabricated for a lower cost than other available technologies.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and together with the detailed description serve to explain the principles of the present invention.

DETAILED DESCRIPTION OF THE PREFERRED EMBODIMENTS

Reference will now be made in detail to a preferred embodiment of the present invention, an example of which is illustrated in the accompanying drawing. A preferred embodiment of the present invention is illustrated by FIGS. 1A, 1B, 1C, and FIGS. 2A and 2B.

The CMC loudspeaker cabinet 10 includes a shell 20, and a face 30. The shell 20 incorporates a novel connector terminal mount 40 as shown in any of FIGS. 1A, 1C, and 2A that is molded as a well into the lower rear edge of the shell 20. The connector terminal mount 40 may be located on any surface of the shell 20. The connector terminal mount 40 allows for the placement of electrical connection devices in a protected, yet accessible location.

Description of a Specific Loudspeaker Enclosure as Illustrated in FIG. 1

Figure 1A:
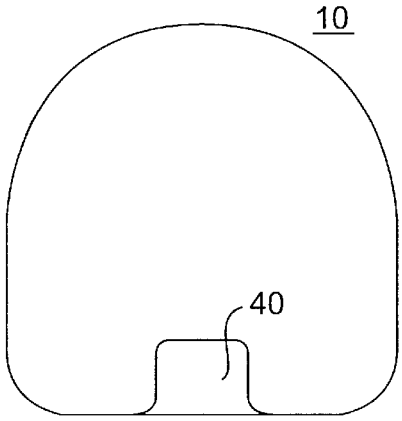
FIG. 1A is a rear view of an embodiment of the present invention.
Figure 1B:
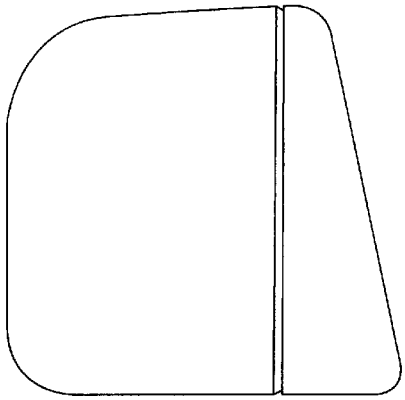
FIG. 1B is a side view of an embodiment of the present invention.
Figure 1C:
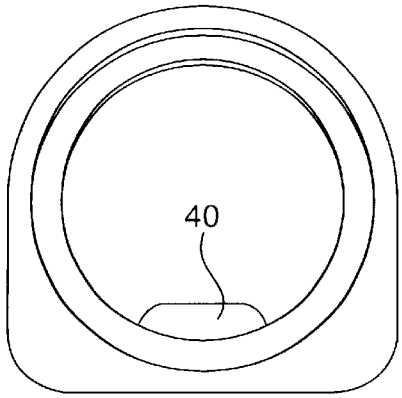
FIG. 1C is a front view of an embodiment of the present invention.
Figure 2A:
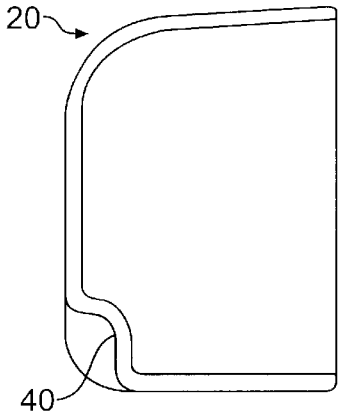
FIGS. 2A and 2B is a cross section in elevation of an embodiment of the present invention.
Figure 2B:
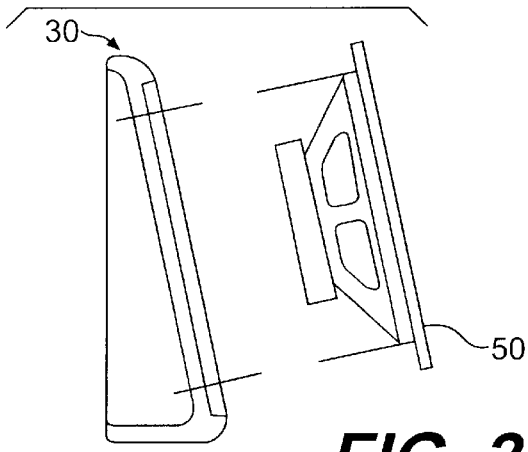

A sub-woofer cabinet in accordance with an embodiment of the present invention is intended for use in an automotive, marine, or any outdoor application is illustrated in FIG. 1. It is sized to mount a 10" diameter sub-woofer loudspeaker 50 designed to operate in the frequency range of 25–150 Hz. The two molded CMC parts, a face 30 and a shell 20 are bonded with a compatible adhesive. The completed CMC cabinet 10 weighs approximately 12 lbs. and has an internal displacement of 0.65 cu. ft. The average and uniform wall thickness of this enclosure is ½". The present invention, however, is not limited to the sub-woofer cabinet 10 illustrated in FIGS. 1A–1C. It is contemplated that the present invention may be used to make a cabinet for any type and size speaker cabinet.

This enclosure incorporates a novel connector terminal mount feature 40 that is a well molded into the lower rear edge of the shell.

Material

The material, CMC, is a blend of various wood fibers, inorganic fillers and property modifying additives combined with a high modulus polymeric resin system. CMC is composed of various combinations of, but is not limited to, the following materials: thermoset resins or any hybrid combination of thermoset resins not limited to but preferably in the range of 25–85%; milled glass fiber not limited to but preferably in the range of 1–10%; fine wood flour (mesh size 100–200) not limited to but preferably in the range of 1–20%; course wood flour (mesh size 10–50) not limited to but preferably in the range of 10–40%; glass bead or fly ash not limited to but preferably in the range of 5–20%; colloidal silica not limited to but preferably in the range of 0.5–3%; fine grind calcium carbonate not limited to but preferably in the range of 5–20%; alumina trihydrate not limited to but preferably in the range of 5–20%; elastomeric particulate (such as, but not limited to, rubber tire regrind) not limited to but preferably in the range of 2–15%; catalyst Methyl Ethyl Ketone Peroxide 9% free oxygen or other comparable catalyst ("MEKP") not limited to but preferably in the range of 1–5%; foaming agent (such as 1,1-dimethylethyl hydrazine chloride and iron chloride or equivalent) not limited to but preferably in the range of 1–3%: and 10–60 mesh organic fibers (such as, but not limited to, jute) not limited to but preferably in the range of 5–10%; finely divided metallic material such as, but not limited to, lead or aluminum not limited to but preferably in the range of 20–50%. An alternative formulation resulting in a water white (clear) enclosure but without the same material density or cost advantages would consist of: thermoset resins not limited to but preferably in the range of 90–99%; catalyst Methyl Ethyl Ketone Peroxide 9% free oxygen or other comparable catalyst not limited to but preferably in the range of 1–10%; resin, fillers, modifiers, and catalyst may be blended in a variety of proportions to provide specific physical and or acoustic characteristics in the final product.

Figure 5:
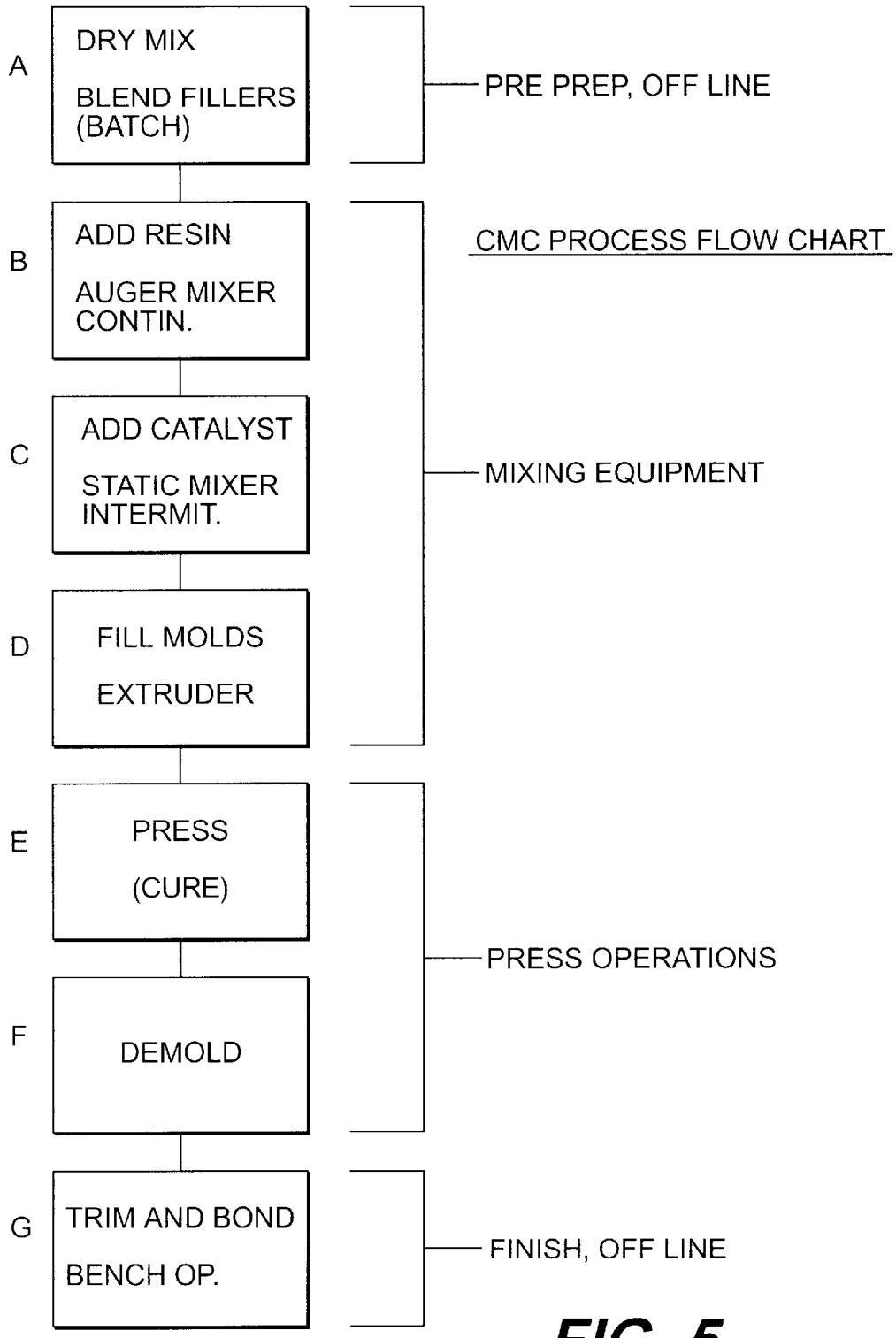
FIG. 5 is a flow chart of the production process for making an embodiment of the present invention.

The Process of Making an Embodiment of the Present Invention is Shown as a Flow Chart in FIG. 5

The dry ingredients are batch blended in a ribbon blender or equivalent. The liquid ingredients, excluding the catalyst, are blended in a high shear mixer of the batch or continuous type. The blended dry and blended liquid ingredients are continuously combined, excluding the catalyst, in an auger mixer in a temperature and/or vacuum controlled environment. The resultant high viscosity mixture (7000–10000 cps) is forced through a multi element static mixer by means of a positive displacement pump. At the static mixer the catalyst (MEKP or equivalent) is introduced into the mix by means of a second positive displacement pump linked to the positive displacement high-viscosity pump. The catalyzed mixture is bulk extruded into the mold by use of a metering extrusion head, the size of the shot to be determined by the volume of the mold. The catalyzed but as yet uncured material is heated upon introduction to the mold by means of a heated mold surface or by means of heaters at the point of extrusion to a temperature between 100–150° to accelerate polymerization and foaming as required. The mold set is closed and the material is distributed and then compressed by the mechanical action of the press to pressures of between but not limited to 5–100 PSI. This pressure is maintained until the material is sufficiently cured to allow removal of the part from the mold. The mixture temperature at the mold surface will be 100–150 deg. F. at the start of the molding cycle rising to 200–350 deg. F. due to exothermic reactions of the resin with the catalyst at the end of the cycle.

The opening of the mold and the removal of the part occurs between 5 and 20 minutes after catalyzation dependent upon material heat, mold heat, catalyst amount and part volume. The molds are of the male/female type and the construction of the molds may be but not limited to any of the following types including laminated polyester glass, laminated epoxy glass, cast epoxy, cast acrylic, polished metal, or electro-formed metal.

The press may be of any size and tonnage appropriate to the part being molded and may be pneumatic or hydraulic in type. It is also possible to use manually operated clamps to close the mold if the required rate of production permits.

Following curing and removal from the mold, the flash is removed and the parts may be bonded together using any appropriate commercial adhesive engineered for use with the resin from which the mixture was made. A spray finish can be applied either automatically or manually if required.

One of the advantages of this material and process over traditional wood construction is that the finished product can be made in any shape conceivable in essentially one operation. The labor costs associated with fabrication and assembly of traditional cabinets are eliminated. Complex hollow forms are assembled from one or more molded pieces to keep the tooling simple. The adhesive used to bond multiple parts is chemically compatible with the castings and the adhesion is made while the part surfaces are still chemically active. The integrity of a near 'single-piece' molded structure results in lower costs for fabrication as well as in a finished part of great inherent strength and durability.

The improved sound quality exhibited by loudspeakers mounted in non-planar surface cabinets made from this material is primarily the result of the near total elimination of standing waves. In an acoustic environment such as a loudspeaker enclosure, standing waves are a response caused by the geometry and materials of the space. At a specific wavelength a space having parallel sound-reflective surfaces (such as the inside of a typical sub-woofer cabinet) will develop a standing wave. This means that any sustained sound put into the space reflects off the parallel surfaces in phase reinforcing itself and builds up in level leading to un-natural distortion and in extreme cases, cancellation of the sound. Because curved surfaces are impractical, the typical solution is to treat the space with sound deadening materials such as fiberglass batting, or to make some of the surfaces angled which helps but does not eliminate the problem.

This lack of frequency specific cancellation results from the absence of flat and parallel reflecting surfaces inside the enclosure. In addition the one-piece construction of the enclosure does not leak air maintaining maximum performance of the loudspeaker. The material itself may be produced in a wide range of densities and may include a range of additives with a concurrent wide range of acoustic damping which can be used to enhance the sound quality of the loudspeaker in any given application. Testing of a 0.65 cu. ft. displacement sealed enclosure mounting a 10" subwoofer has yielded the results in FIGS. 6 and 7. This testing demonstrates highly efficient power output with minimal distortion through the loudspeaker's full range of rated frequencies.

This new material is weatherproof; it will withstand extremes of temperature and humidity beyond the capability of wood and of sheet pressed wood products. Sections of molded material have been boiled for longer than 12 hours with no deleterious effect on the structure or appearance of the sample. Unlike fabricated wood materials which are generally pressed powders, CMC is totally non-permeable and will not permit the passage of water or air. Additionally, this material can be drilled and tapped to accept threaded fasteners and machined to accurate, stable dimensions.

It will be apparent to those skilled in the art that various modifications and variations can be made in the construction, configuration, and/or operation of the present invention without departing from the scope or spirit of the invention. For example, in the embodiments mentioned above, various changes may be made to the composition and process for making the loudspeaker cabinet without departing from the scope and spirit of the invention. Further, it may be appropriate to make additional modifications or changes to the shape or size of the loudspeaker cabinet without departing from the scope of the invention. Thus, it is intended that the present invention covers the modifications and variations of the invention provided they come within the scope of the appended claims and their equivalents.

EXAMPLE 1

Process for Making an Embodiment of the Present Invention

The CMC formulation used to make an embodiment of the present invention is as follows:

| Item | % by Wt. | Description |
|---|---|---|
| Resin | 76.81 | Unsaturated polyester thermoset resin |
| Coarse wood | 13.32 | Pine wood flour (20 mesh) |
| Fine wood | 1.78 | Pine wood (100 mesh) |
| Glass bead | 5.96 | Glass bead |
| Silica | 0.59 | AeroSil |
| Catalyst | 1.54 | MEKP |

Figure 4:
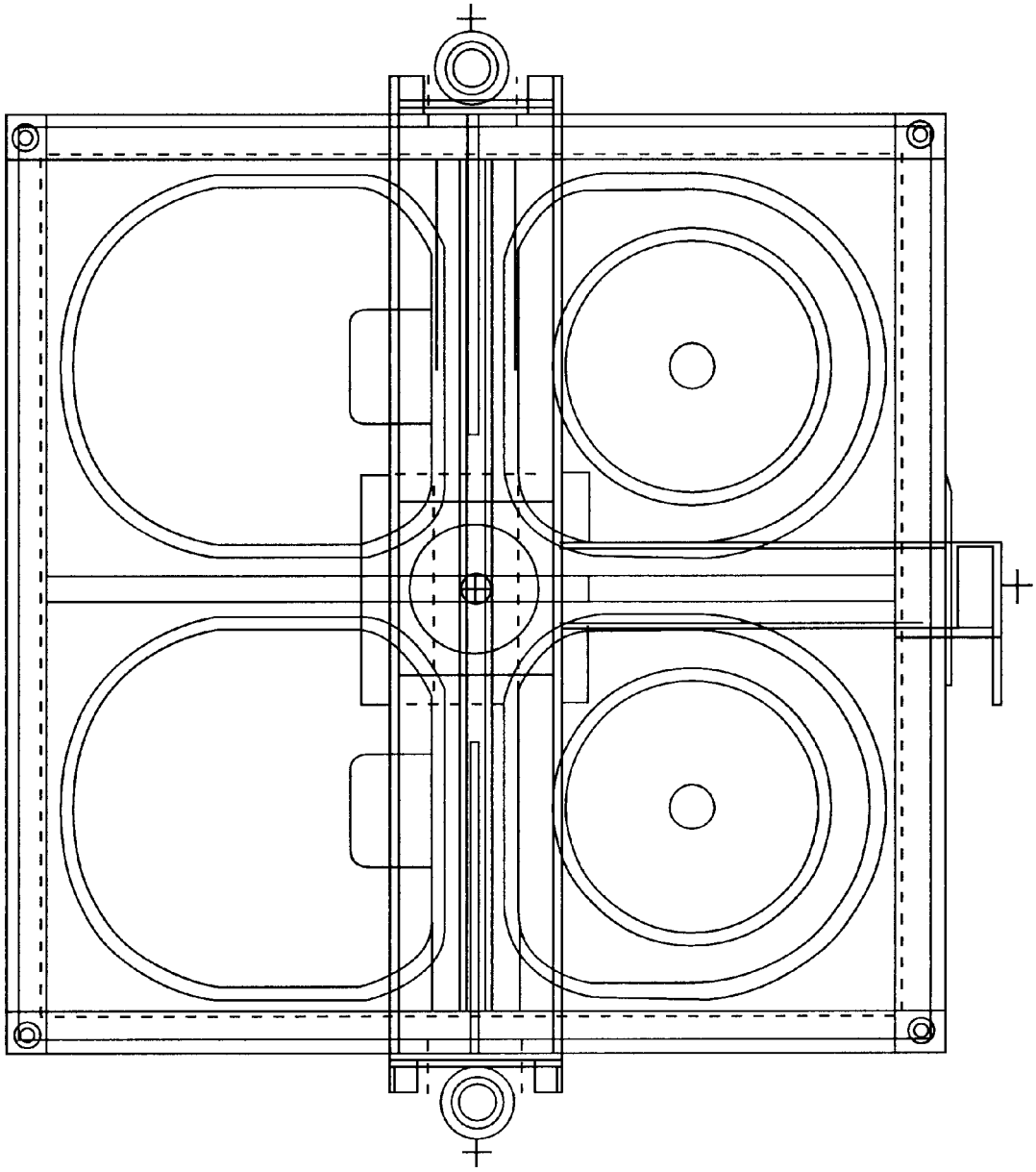
FIG. 4 is a plan view of FIG. 3.

As shown in FIG. 4, the coarse wood, fine wood, glass bead, and silica are batch blended in a mechanical blender (ribbon blender) (Step A).

The dry filler blend is fed by means of an auger metering device into the auger mixer (Giesco Mixer) along with the thermoset resin which is metered proportionally by means of a positive displacement pump internal to the mixing machine (Step B). The wet mixed material is discharged into the input hopper of a second mixing machine incorporating a static mix tube and catalyst metering pump (Liquid Control Meter Mixer) (Step C). The catalyst is added and the activated material is extruded through the static mix tube which is heated to 120 deg. F. The material is metered into the open molds (bottom mold sections) by volume as indicated by the pump stroke count (Step D).

Figure 3:
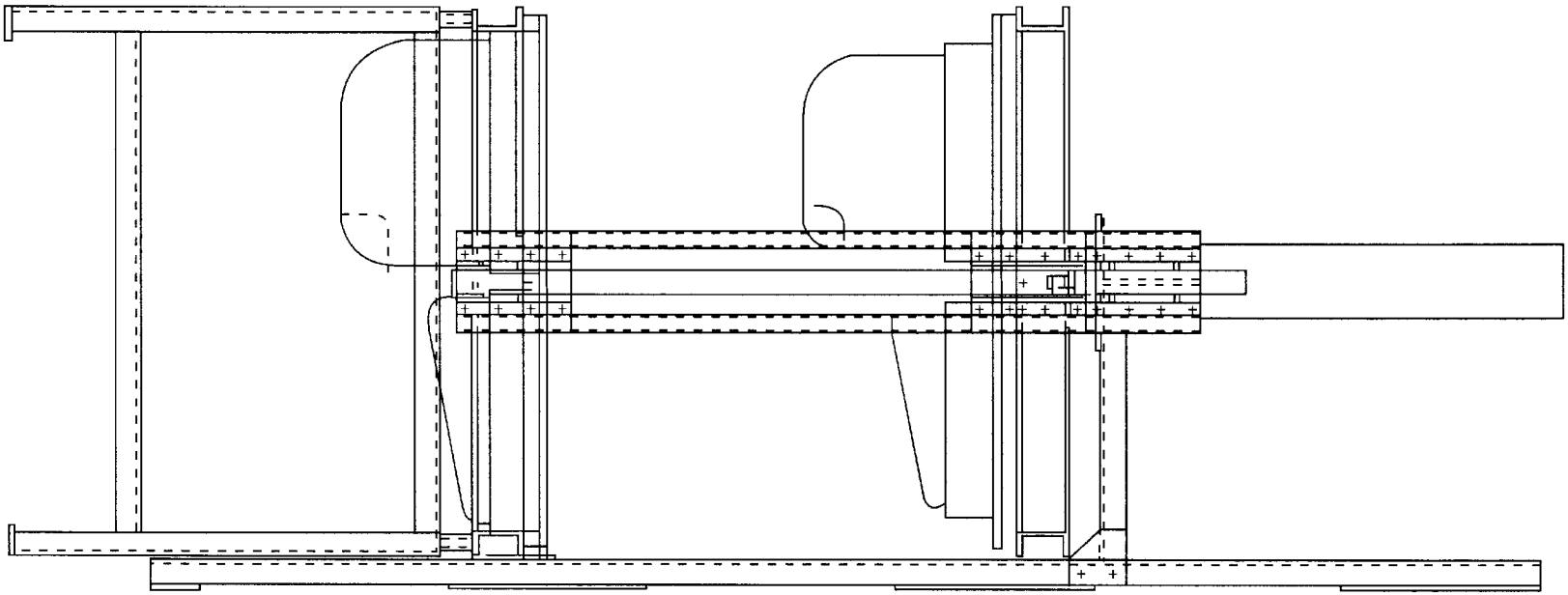
FIG. 3 is a side view of two typical sets of molds in a press used in the process to make an embodiment of the present invention.

Two parts are required to make one complete assembled enclosure, a face (approximately 3 lbs.) and a shell (approximately 9 lbs.). There may be 2 bottom face molds and 2 bottom shell molds in the lower platen and 2 top face molds and 2 top shell molds in the moving upper platen of the press. Each of the mold sections may be constructed of laminated polyester tooling resin and glass fiber and may be supported by an integral welded steel frame. Each mold section used to make this enclosure may weigh approximately 25 lbs. and may be approximately 16"×16"×12" in size. These molds are mounted in an air-operated press designed specifically for this enclosure and process, as shown in FIG. 3 and FIG. 4. The present invention, however, is not limited to configurations described above, rather, it is contemplated that various sizes and shapes may be used to construct the desired cabinets.

Once the correct amount of catalyzed CMC is extruded into each bottom mold the mixer is shut down and flushed out and the press is activated to close the molds (Step E). At 7 minutes into the cure the press is opened and the parts are allowed to continue to cure and gain rigidity in the open bottom molds for an additional 3 minutes. When the parts are rigid enough they are lifted from the molds (Step F), the flash is trimmed, and the parts are left to cool and finish curing. As soon as the parts have cooled (approximately 20 minutes after the addition of the catalyst) they are bonded. The adhesive (Lord 660 acrylic adhesive or equivalent) is mixed and applied to one bonding surface and a face and shell are pressed together and held in place in an alignment fixture until the adhesive is set (approximately 5 minutes). The assembly is removed from the fixture after the adhesive has set and the part is wiped with solvent and sent to be painted (Step G).

FIG. 5 presents the description of and the process for producing the loudspeaker enclosure illustrated in FIG. 1 above.

Figure 6:
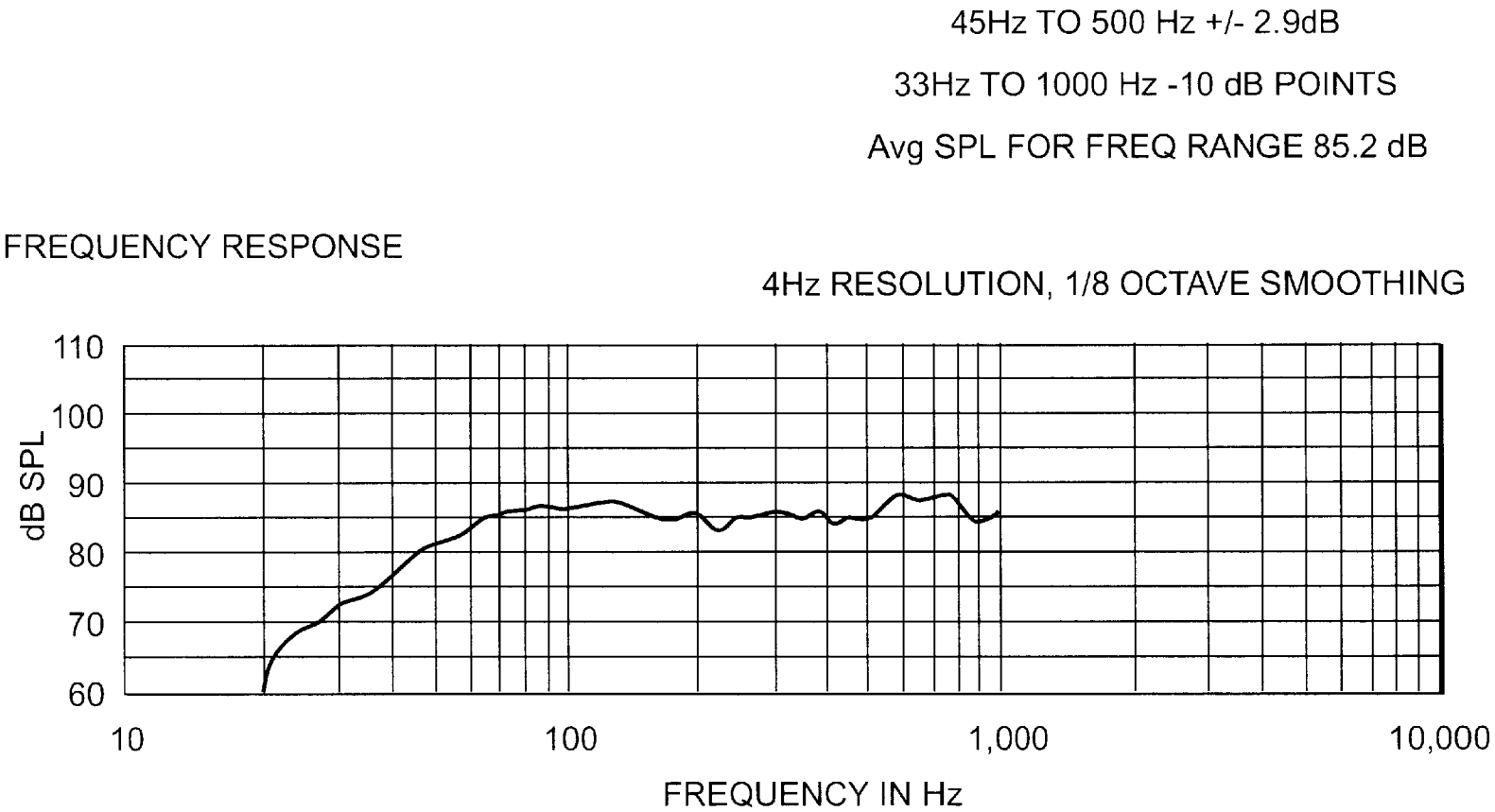
FIG. 6 is a graphical representation of the frequency response of a loudspeaker mounted in an embodiment of the present invention.

As shown in FIG. 6, the ability to mold enclosures with curved interior surfaces reduces standing waves which in test results shows smooth transition from 30 Hz to 1000 Hz without any appreciable cancellation (negative spikes). In this embodiment the loudspeaker is designed to operate at 40 Hz or higher.

Figure 7:
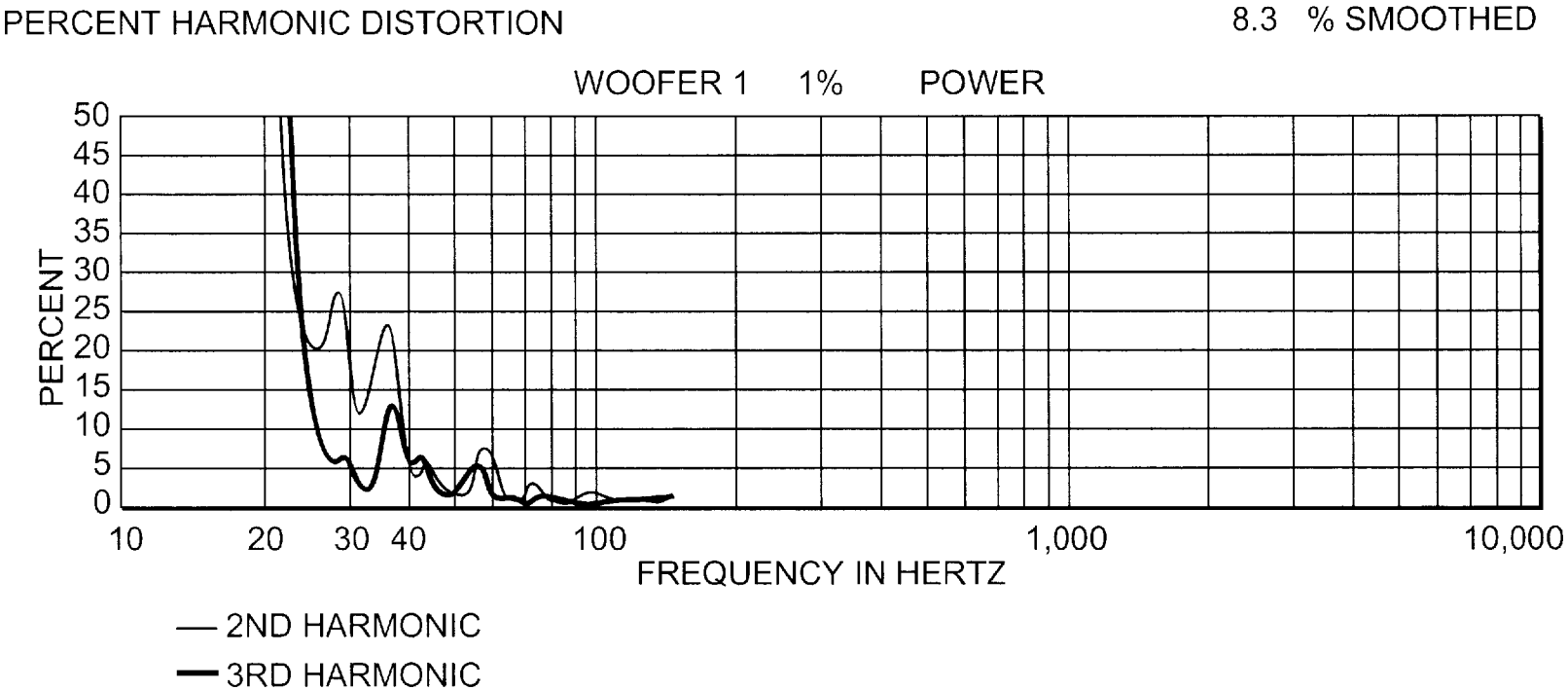
FIG. 7 is a graphical representation of the percent harmonic distortion of a loudspeaker mounted in an embodiment of the present invention.

As shown in FIG. 7, this test shows second harmonic distortion is all but eliminated, on average, from 40 Hz to 1000 Hz. (second harmonic should be generally below 5%). In this embodiment the loudspeaker is designed to operate at 40 Hz or higher.

I claim:

1. A loudspeaker cabinet comprising at least one wall made of a compression molded cellulose material, wherein said compression molded cellulose material comprises one or more thermoset resins.

2. A loudspeaker cabinet comprising: a face portion; a shell portion; and means to join said face portion to said shell portion; wherein said shell portion is composed of a compression molded cellulose material, wherein said compression molded cellulose material comprises one or more thermoset resins.

3. The loudspeaker cabinet according to claim 2, wherein said face portion is composed of a compression molded cellulose material.

4. The loudspeaker cabinet according to claim 2, wherein said shell portion contains a recessed area to accommodate speaker terminal connections.

5. The loudspeaker cabinet according to claim 2, wherein said face portion possesses a means to mount a loudspeaker to said face portion.

6. The loudspeaker cabinet according to claim 2, wherein said shell portion and said face portion contain curved interior and exterior surfaces.

7. The loudspeaker cabinet according to claim 1, wherein said compression molded cellulose material is of uniform density.

8. The loudspeaker cabinet according to claim 1, wherein said compression molded cellulose material comprises thermoset resins in the range of 25–85%.

9. The loudspeaker cabinet according to claim 1, wherein said compression molded cellulose material comprises milled glass fiber in the range of 1–10%.

10. The loudspeaker cabinet according to claim 1, wherein said compression molded cellulose material comprises fine wood flour in the range of 1–20%.

11. The loudspeaker cabinet according to claim 1, wherein said compression molded cellulose material comprises course wood flour in the range of 10–40%.

12. The loudspeaker cabinet according to claim 1, wherein said compression molded cellulose material comprises glass beads in the range of 5–20%.

13. The loudspeaker cabinet according to claim 1, wherein said compression molded cellulose material comprises fly ash in the range of 5–20%.

14. The loudspeaker cabinet according to claim 1, wherein said compression molded cellulose material comprises colloidal silica in the range of 0.5–3%.

15. The loudspeaker cabinet according to claim 1, wherein said compression molded cellulose material comprises fine grind calcium carbonate in the range of 5–20%.

16. The loudspeaker cabinet according to claim 1, wherein said compression molded cellulose material comprises alumina trihydrate in the range of 5–20%.

17. The loudspeaker cabinet according to claim 1, wherein said compression molded cellulose material comprises elastomeric particulate in the range of 2–15%.

18. The loudspeaker cabinet according to claim 1, wherein said compression molded cellulose material comprises a catalyst in the range of 1–5%.

19. The loudspeaker cabinet according to claim 1, wherein said compression molded cellulose material comprises a foaming agent in the range of 1–3%.

20. The loudspeaker cabinet according to claim 1, wherein said compression molded cellulose material comprises organic fibers in the range of 5–10%.

21. The loudspeaker cabinet according to claim 1, wherein said compression molded cellulose material comprises finely divided metallic material in the range of 20–50%.

22. The loudspeaker cabinet according to claim 8, wherein said thermoset resins are selected from the group consisting of polyester thermoset resins, polyurethane thermoset resins, epoxy thermoset resins, and phenolic thermoset resins.

23. The loudspeaker cabinet according to claim 8, wherein said thermoset resins are blended unsaturated polyester thermoset resins.

24. The loudspeaker cabinet according to claim 8, wherein said thermoset resins are any hybrid combination of thermoset resins.

25. The loudspeaker cabinet according to claim 10, wherein said fine wood flour is mesh size 100–200.

26. The loudspeaker cabinet according to claim 11, wherein said course wood flour is mesh size 10–50.

27. The loudspeaker cabinet according to claim 17, wherein said elastomeric particulate is comprised of rubber.

28. The loudspeaker cabinet according to claim 17, wherein said elastomeric particulate is rubber tire regrind.

29. The loudspeaker cabinet according to claim 18, wherein said catalyst is Methyl Ethyl Ketone Peroxide.

30. The loudspeaker cabinet according to claim 18, wherein said catalyst is Methyl Ethyl Ketone Peroxide 9% free oxygen.

31. The loudspeaker cabinet according to claim 19, wherein said foaming agent is 1,1-dimethylethyl hydrazine chloride.

32. The loudspeaker cabinet according to claim 19, wherein said foaming agent is iron chloride.

33. The loudspeaker cabinet according to claim 20, wherein said organic fibers are mesh size 10–60.

34. The loudspeaker cabinet according to claim 20, wherein said organic fibers are jute.

35. The loudspeaker cabinet according to claim 21, wherein said metallic material is lead.

36. The loudspeaker cabinet according to claim 21, wherein said metallic material is aluminum.

37. A loudspeaker cabinet comprised of a compression molded cellulose material, wherein said compression molded cellulose material comprises unsaturated polyester thermoset resins in the range of 90–99%.

38. The loudspeaker cabinet according to claim 37, wherein said compression molded cellulose material comprises the catalyst Methyl Ethyl Ketone Peroxide 9% free oxygen in the range of 1–10%.

39. A loudspeaker cabinet comprised of compression molded cellulose material, wherein said compression molded cellulose material comprises:

thermoset resin in the range of 71–83%;

coarse wood in the range of 10–16%;

fine wood in the range of 1–3%;

glass bead in the range of 4–8%;

silica in the range of 0.1–2%; and catalyst in the range of 1–3%.

40. The compression molded cellulose material according to claim 39, wherein said thermoset resin is an unsaturated polyester thermoset resin.

41. The compression molded cellulose material according to claim 39, wherein said course wood is 20 mesh pine wood flour.

42. The compression molded cellulose material according to claim 39, wherein said fine wood is 100 mesh pine wood.

43. The compression molded cellulose material according to claim 39, wherein said silica is AeroSil.

44. The compression molded cellulose material according to claim 39, wherein said catalyst is Methyl Ethyl Ketone Peroxide 9% free oxygen.

* * * * *